US008042968B2

(12) United States Patent
Boyer et al.

(10) Patent No.: US 8,042,968 B2
(45) Date of Patent: Oct. 25, 2011

(54) MODULAR LIGHT REFLECTORS AND ASSEMBLIES FOR LUMINAIRE

(75) Inventors: John D. Boyer, Lebanon, OH (US); James G. Vanden Eynden, Hamilton, OH (US); Larry A. Akers, Clarksville, OH (US)

(73) Assignee: LSI Industries, Inc., Cincinnati, OH (US)

( * ) Notice: Subject to any disclaimer, the term of this patent is extended or adjusted under 35 U.S.C. 154(b) by 163 days.

(21) Appl. No.: 12/615,851

(22) Filed: Nov. 10, 2009

(65) Prior Publication Data

US 2011/0110080 A1 May 12, 2011

(51) Int. Cl.
*F21V 1/00* (2006.01)

(52) U.S. Cl. ..... 362/235; 362/345; 362/217.03; 362/279; 362/341; 362/296.01

(58) Field of Classification Search ..... 362/800, 362/235, 249.02, 279, 290, 292, 296.01, 362/298, 341–344, 217.03, 217.05
See application file for complete search history.

(56) References Cited

U.S. PATENT DOCUMENTS

| | | | |
|---|---|---|---|
| 1,235,274 | A | 7/1917 | Wood |
| 1,365,319 | A | 1/1921 | Hazard |
| 1,563,102 | A | 11/1925 | Obsurn |
| 3,701,898 | A | 10/1972 | McNamara, Jr. |
| 4,007,365 | A | 2/1977 | Stempfle et al. |
| 4,161,014 | A | 7/1979 | Dey et al. |
| 4,320,442 | A | 3/1982 | McCamy |
| 4,337,507 | A | 6/1982 | Lasker |
| 4,358,816 | A | 11/1982 | Soileau |
| 4,383,289 | A | 5/1983 | Lewin |
| 4,425,603 | A | 1/1984 | Courson |
| 4,432,044 | A | 2/1984 | Lautzenheiser |
| 4,507,717 | A | 3/1985 | Wijbenga |

(Continued)

FOREIGN PATENT DOCUMENTS

AU 2008200821 4/2009

(Continued)

OTHER PUBLICATIONS

New Zealand Patent Application No. 583904, Examination Report, mailed Mar. 19, 2010, Intellectual Property Office of New Zealand.

(Continued)

*Primary Examiner* — Anabel Ton
(74) *Attorney, Agent, or Firm* — McDermott Will & Emery LLP

(57) ABSTRACT

A reflector assembly for a lighting apparatus, the reflector assembly comprising two or more reflector modules configured for associating with one or more light sources, each reflector module comprising one or more reflectors for being located adjacent to a light source when the reflector module is associated with the one or more light sources, the one or more reflectors configured to reflect light from the adjacent light source. The reflector modules may further comprising a cover plate defining a plurality of light source apertures for allowing a light source to protrude through the cover plate, at least a first of the one or more light source apertures disposed adjacent to an overhead reflector and at least a second of the one or more light source apertures disposed adjacent to a lateral reflector. The reflector assembly can comprising any number of reflector modules and the reflector modules can be arranged in different configurations to create different light distributions with the same reflector modules.

28 Claims, 12 Drawing Sheets

U.S. PATENT DOCUMENTS

| | | | | |
|---|---|---|---|---|
| 4,536,828 | A | 8/1985 | Mori | |
| 4,617,612 | A | 10/1986 | Pritchett | |
| 4,641,226 | A | 2/1987 | Kratz | |
| 4,694,382 | A | 9/1987 | Sales | |
| 4,847,734 | A | 7/1989 | Katoh et al. | |
| 5,438,485 | A | 8/1995 | Li et al. | |
| 5,440,467 | A | 8/1995 | Lautzenheiser | |
| 5,473,522 | A | 12/1995 | Kriz et al. | |
| 5,523,930 | A | 6/1996 | Fritts | |
| 5,561,346 | A | 10/1996 | Byrne | |
| 5,582,480 | A | 12/1996 | Zwick et al. | |
| 5,660,461 | A | 8/1997 | Ignatius et al. | |
| 6,166,860 | A | 12/2000 | Medvedev et al. | |
| 6,206,548 | B1 | 3/2001 | Lassovsky | |
| 6,386,723 | B1 | 5/2002 | Eberlein et al. | |
| 6,431,726 | B1 | 8/2002 | Barton | |
| 6,474,848 | B1 | 11/2002 | Lahner et al. | |
| 6,705,744 | B2 | 3/2004 | Hubbell | |
| 6,818,864 | B2 | 11/2004 | Ptak | |
| 6,840,654 | B2 | 1/2005 | Guerrieri et al. | |
| 6,893,140 | B2 | 5/2005 | Storey et al. | |
| 7,021,806 | B2 | 4/2006 | Ovenshire | |
| 7,090,370 | B2 | 8/2006 | Clark | |
| 7,275,841 | B2 | 10/2007 | Kelly | |
| 7,293,908 | B2 | 11/2007 | Beeson et al. | |
| 7,312,560 | B2 | 12/2007 | Ouderkirk et al. | |
| 7,758,212 | B2 * | 7/2010 | Jan et al. | 362/249.02 |
| 7,780,306 | B2 | 8/2010 | Hoshi | |
| 7,828,456 | B2 * | 11/2010 | Boyer et al. | 362/153.1 |
| 7,896,514 | B2 * | 3/2011 | Gomi | 362/97.3 |
| 2004/0188593 | A1 | 9/2004 | Mullins et al. | |
| 2005/0265035 | A1 | 12/2005 | Brass et al. | |
| 2009/0103288 | A1 | 4/2009 | Boyer et al. | |

FOREIGN PATENT DOCUMENTS

| | | | |
|---|---|---|---|
| DE | 7540059 | | 5/1976 |
| EP | 0560327 | A2 | 9/1993 |
| EP | 1496488 | A1 | 1/2005 |
| EP | 1586814 | A2 | 10/2005 |
| EP | 2019250 | | 1/2009 |
| WO | 9622490 | A1 | 7/1996 |
| WO | 2005066537 | A1 | 7/2005 |
| WO | 2005066539 | A1 | 7/2005 |
| WO | WO 2007/117608 | | 10/2007 |
| WO | WO 2008/140884 | | 11/2008 |
| WO | WO 2009/052094 | A1 | 4/2009 |
| WO | WO 2009/094819 | A1 | 8/2009 |

OTHER PUBLICATIONS

Philips Lumileds Lighting Company, Luxeon Emitter Technical Data Sheet DS25, downloaded from www.luileds.com/pdfs/DS25.PDF (2007).

International Search Report and Written Opinion for corresponding PCT Application No. PCT/US08/079810 (8 pages).

LED Wall Light Product Sheet, Crossover, Solid-State Lighting, LSI Industries, Inc (2009).

Installation and Assembly Instructions for Crossover XAS/XAM Area Series & XRS/XRM Roadway Series, LSI Industries, Inc. (2009).

A Complete System—Roadway Fixture, Mast Arm & Tenon Pole or Just the Fixture, Ordering Your Crossover Roadway Lighting from LSI is as Easy as 1, 2, 3 (2009).

Crossover XPG 5 LED 50 and Crossover XPG HL 5 LED 68 Product and Installation Sheet (2009).

LED Garage Light (XPG) Product Sheet, Crossover, Solid-State Lighting, LSI Industries, Inc. (2009).

LED Garage Light (XPG—HL) Product Sheet, Crossover, Solid-State Lighting, LSI Industries, Inc. (2009).

LED Multi-Purpose Light (XPG) Product Sheet, Crossover, Solid-State Lighting, LSI Industries, Inc. (2009).

Philips Apollo Streetlight Overview Product Sheet (2009).

LED Multi-Purpose Light (XPG—HL) Product Sheet, Crossover, Solid-State Lighting, LSI Industries, Inc. (2009).

Australian Examination Report dated Feb. 8, 2011 from corresponding Australian Application No. 2008312668.

European Search Report dated Mar. 11, 2011 from corresponding European Application No. 08166681.0.

Extended European Search Report dated Dec. 23, 2010 from corresponding European Application No. 10157195.8.

Office Action dated Mar. 1, 2011 from corresponding Australian Application No. 2010200941.

Response the New Zealand Examination Report filed on Mar. 3, 2011 from corresponding New Zealand Application No. 583904.

Response to the Examination Report from Corresponding New Zealand Application No. 583904 filed Jul. 1, 2011.

Response to the Examination Report from Corresponding Australian Application No. 2010200941 filed Jul. 1, 2011.

Examination Report from Corresponding New Zealand Application No. 583904 dated Jun. 1, 2011.

Examination Report from Corresponding New Zealand Application No. 583904 mailed Jul. 13, 2011.

Examination Report from Corresponding Australian Application No. 2010200941 mailed Jul. 22, 2011.

* cited by examiner

MODULAR LIGHT REFLECTORS AND ASSEMBLIES FOR LUMINAIRE

FIELD OF THE DISCLOSURE

The present disclosure relates generally to a luminaire and, more particularly, to a luminaire for lighting an area such as a parking lot, parking garage, roadway or the like and, even more particularly, to a reflector assembly having a plurality of modular reflectors for directing light from one or more light sources. The disclosure finds particularly useful application when the luminaire employs multiple light sources including, in one embodiment, one or more light emitting diodes (LEDs).

BACKGROUND OF THE DISCLOSURE

Uncontrolled light can be wasted in lighting areas around the target area to be lighted, and contributes to unwanted "night lighting" which can interfere with the preservation and protection of the nighttime environment and our heritage of dark skies at night. Uncontrolled light also necessitates generation of greater amounts of light to meet the lighting requirements in the target area requiring higher power equipment and energy consumption to provide the target area with the desired amount of light.

The Illuminating Engineering Society of North America ("IESNA") defines various light distribution patterns for various applications. For example, the IESNA defines Roadway Luminaire Classification Types I-V for luminaires providing roadway and area lighting. The IESNA defines other informal classifications for light distribution patterns provided by roadway and area luminaires as well as light distribution patterns for other applications. These and other light distribution patterns can be obtained by directing light emitted from the one or more light sources in a luminaire. This holds true regardless of light source.

When the light source is one or more LEDs (or other small light sources), it is known to distribute the emitted light by one or more reflectors associated with one or more light sources. One example of a reflector system for distributing light emitted from LEDs is disclosed in U.S. patent application Ser. No. 12/166,536 filed Jul. 2, 2008, the entirety of which is incorporated herein by reference.

Improvements in LED lighting technology have led to the development by Osram Sylvania of an LED having an integral optic that emits a significant portion of the LED light bilaterally and at high angle $\alpha$ (about 60°) from nadir, which is available as the Golden DRAGON® LED with Lens (hereinafter, "bilateral, high angular LED"). FIG. 1A is a representation of the bilateral, high angular LED 252 showing the direction and angle of the lines 255 of maximum light intensity emitted by the LED, substantially in opposed designated ±Z axes. Progressively and significantly lower levels of light intensity are emitted at angles in the Y-Z plane diverging from lines 255 and along vectors directed toward the transverse direction (±X axes) normal to the image of the figure. The radiation characteristics of the LED 252 are shown in FIG. 1B. These or other LEDs (or other light sources) can be arranged in a lighting apparatus in conjunction with a reflector system to distribute the light emitted from the light sources (which include, by definition, LEDs) to efficiently meet the light distribution needs of various applications with a minimum of wasted light.

SUMMARY OF THE DISCLOSURE

The present disclosure relates to a reflector assembly configured to efficiently distribute light emitted from one or more light source in a luminaire. The reflector assembly is comprised of a plurality of reflector modules each associated with a different set of light sources of the luminaire. The reflector modules can be arranged in different configurations to create different light distributions. By way of example only, the luminaire depicted in FIGS. 2 and 3 can be configured as either a Type II or a Type V IESNA Roadway Luminaire with the same reflector modules depending on their arrangement and orientation within the luminaire. In particular, the reflector assembly depicted in FIGS. 2 and 3 are configured to provide a light distribution pattern approximating an IESNA Type V distribution. However, these same reflector modules may be rearranged to the configuration depicted in FIG. 7 to provide a light distribution pattern approximating an IESNA Type II distribution.

In one embodiment, the present disclosure relates to a reflector assembly for a lighting apparatus, the reflector assembly comprising two or more reflector modules configured for associating with one or more light sources; each reflector module comprising one or more reflectors for being located adjacent to a light source when the reflector module is associated with the one or more light sources, the one or more reflectors configured to reflect light from the adjacent light source.

In another embodiment, the present disclosure relates to a lighting apparatus comprising one or more light sources; a reflector assembly having two or more reflector modules, the reflector modules associated with the one or more light sources; each reflector module comprises one or more reflectors located adjacent to a light source, the one or more reflectors configured to reflect light from the adjacent light source.

The reflector modules of the present disclosure permit the manufacture of different reflector assemblies from reflector modules of the same configuration by orienting one or more of the reflector modules differently. The reflector assemblies of the present disclosure also permits the manufacture of reflector assemblies comprising reflector modules of different configurations. The reflector of the present disclosure thus provides multiple reflector assembly configurations with relatively fewer configurations of reflector modules. The disclosed reflector assemblies thereby lower the number of different parts required to be manufactured or maintained in inventory and decreases the size of parts maintained in inventory thereby lowering costs of inventory and manufacturing while increasing manufacturing flexibility.

DETAILED DESCRIPTION OF THE PREFERRED EMBODIMENTS

Figure 1A:
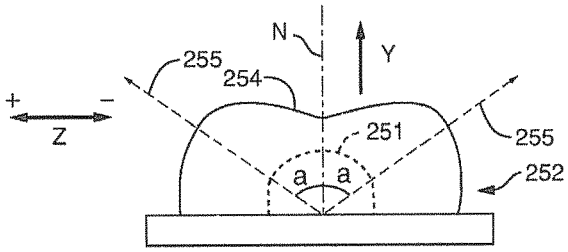
FIG. 1A (PRIOR ART)
FIG. 1A depicts a prior art wide-angle LED with refractor of the type finding use in the present disclosure.
Figure 1B:
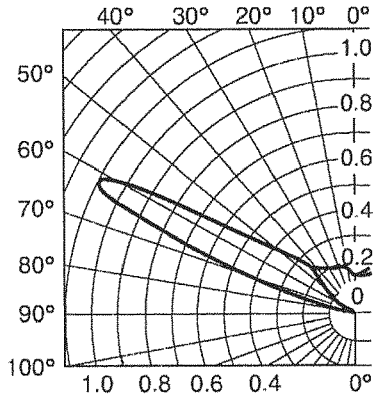
FIG. 1B (PRIOR ART)
FIG. 1B depicts the radiation characteristics of the wide-angle LED of FIG. 1A.
Figure 2:
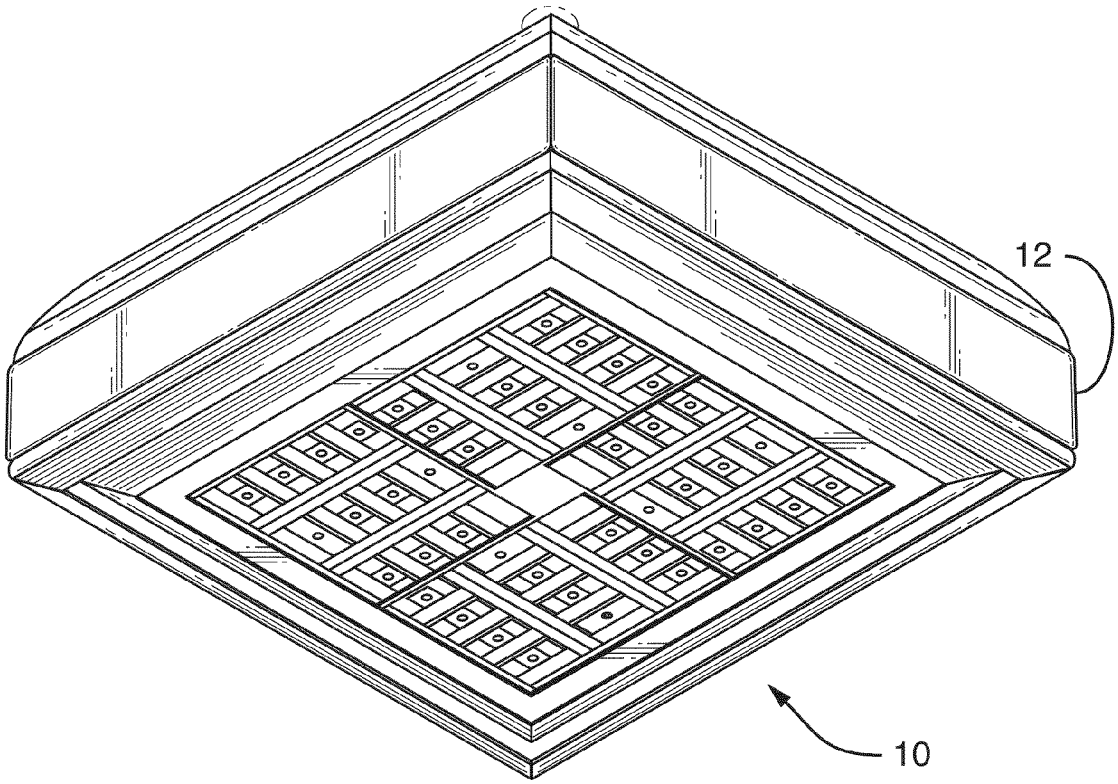
FIG. 2 is a perspective view of a luminaire comprising one embodiment of a reflector assembly and reflector module of the present disclosure.
Figure 3:
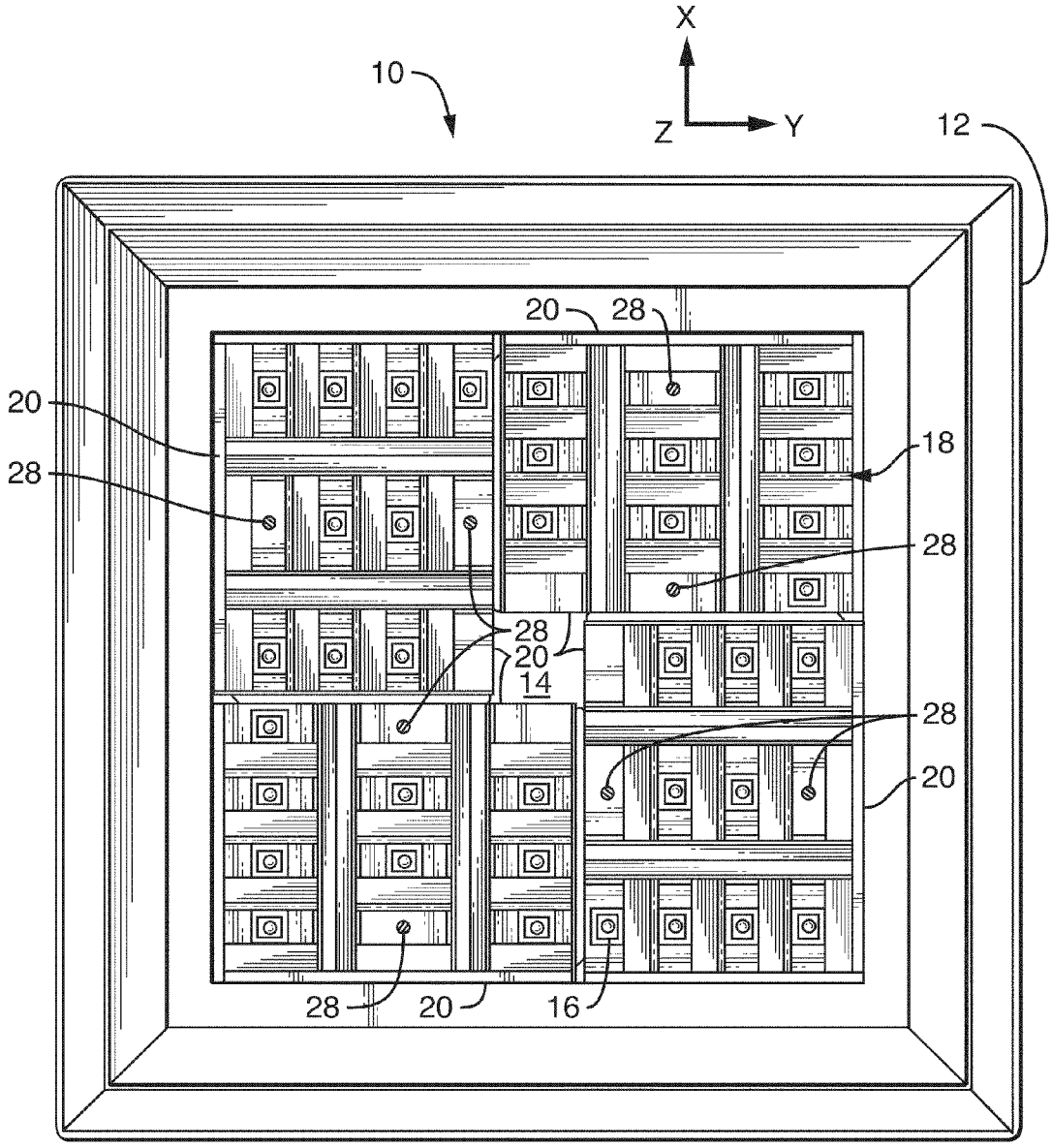
FIG. 3 is a bottom plan view of the luminaire of FIG. 2.
Figure 4A:
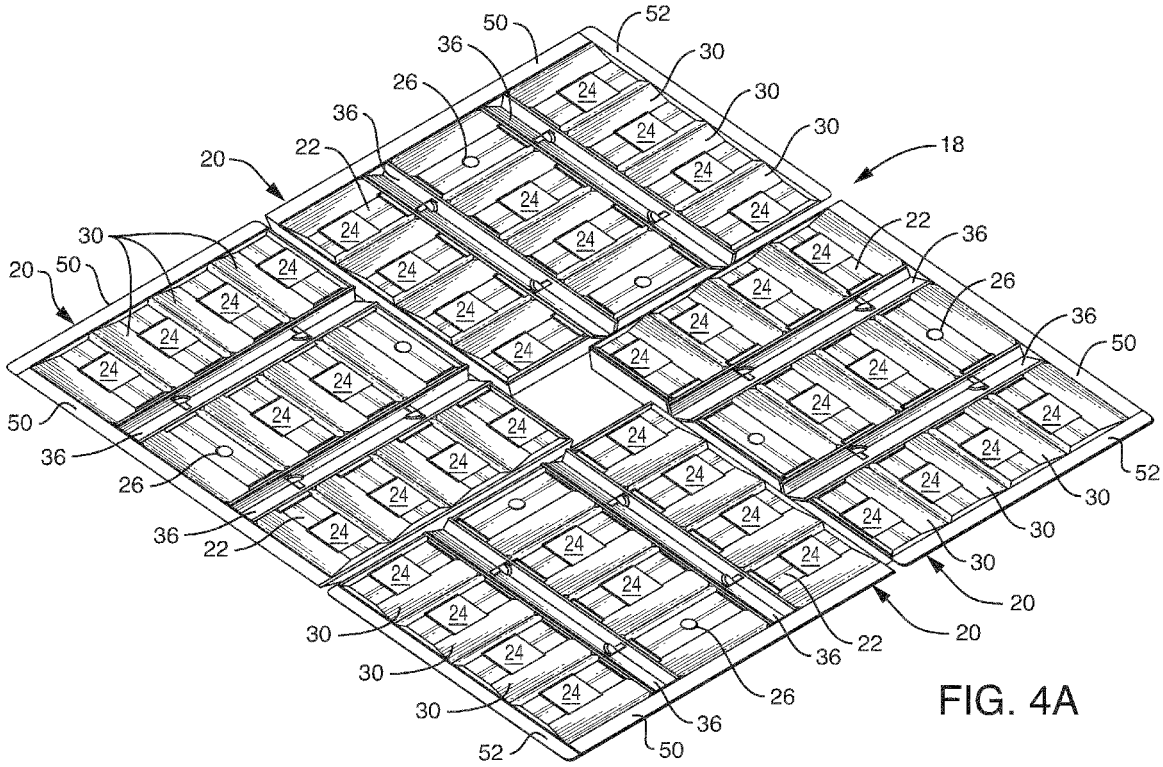
FIG. 4A is a perspective view of the reflector assembly of FIG. 2.
Figure 4B:
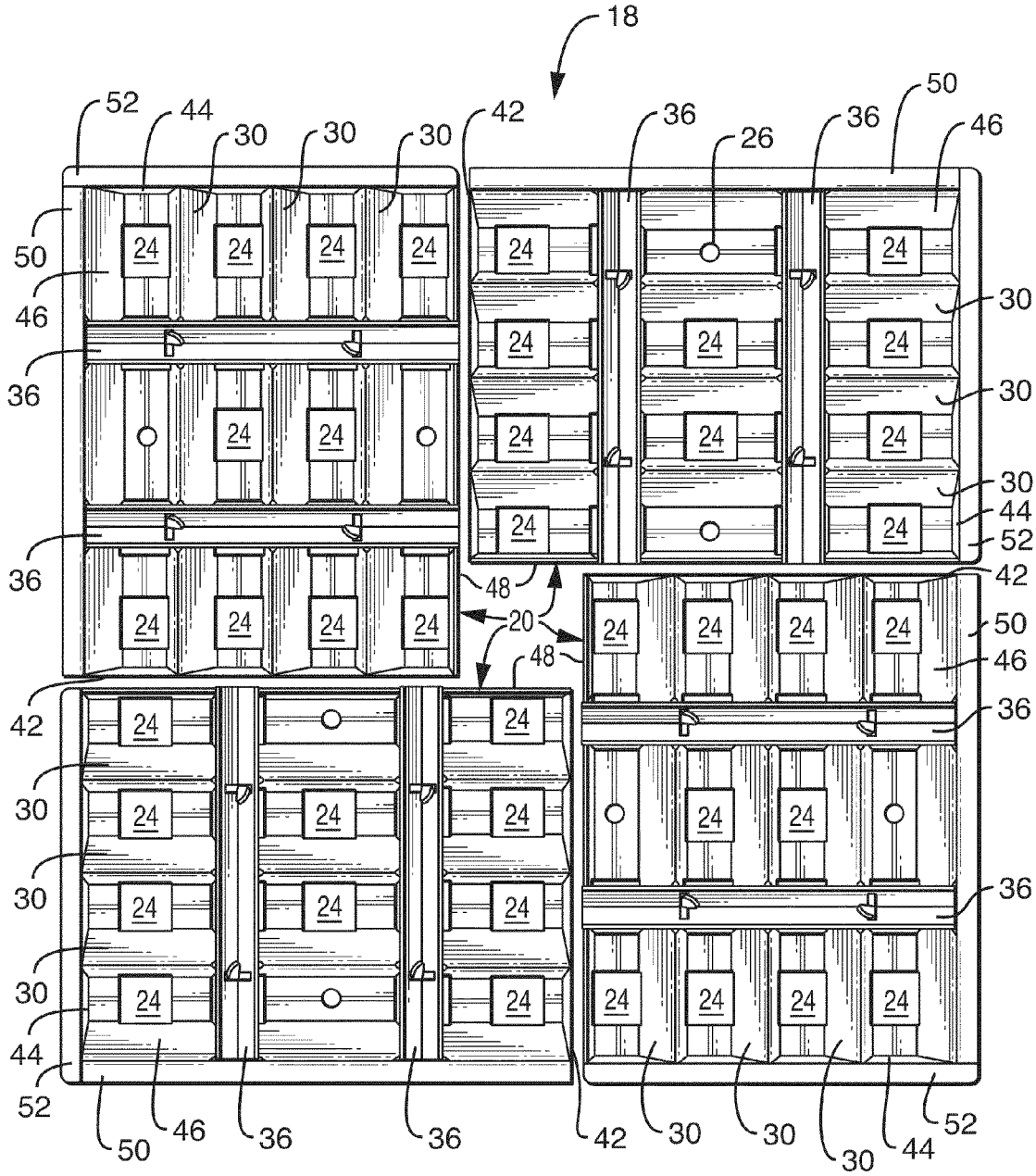
FIG. 4B is a bottom plan view of the reflector assembly of FIG. 4A.
Figure 4C:
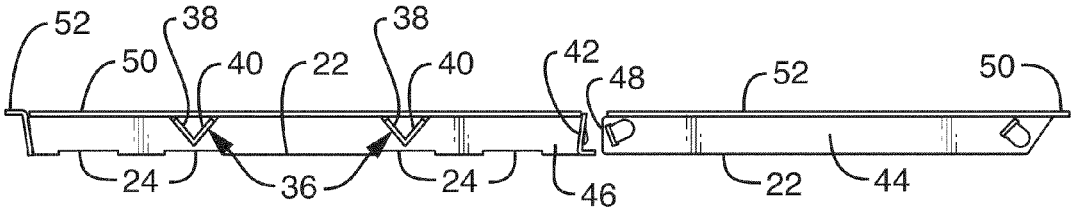
FIG. 4C is a right-side elevational view of the reflector assembly of FIG. 4A.
Figure 4D:
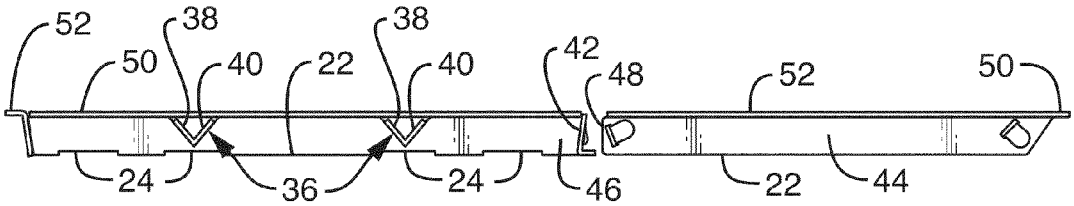
FIG. 4D is a left-side elevational view of the reflector assembly of FIG. 4A.
Figure 4E:
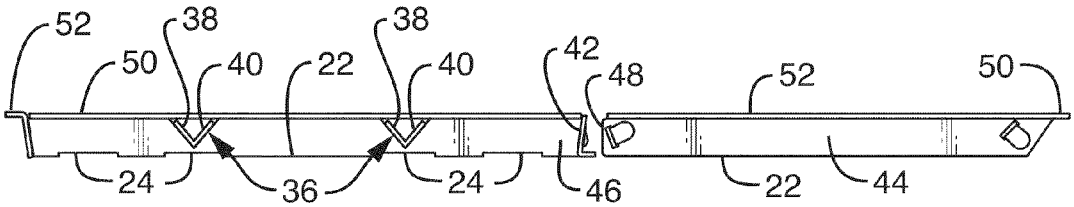
FIG. 4E is a front-side elevational view of the reflector assembly of FIG. 4A.
Figure 4F:
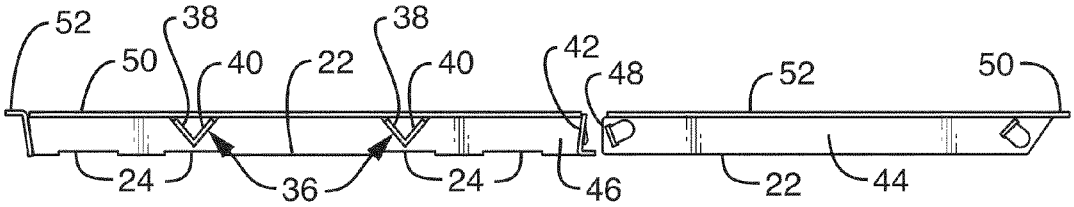
FIG. 4F is a back-side elevational view of the reflector assembly of FIG. 4A.
Figure 5A:
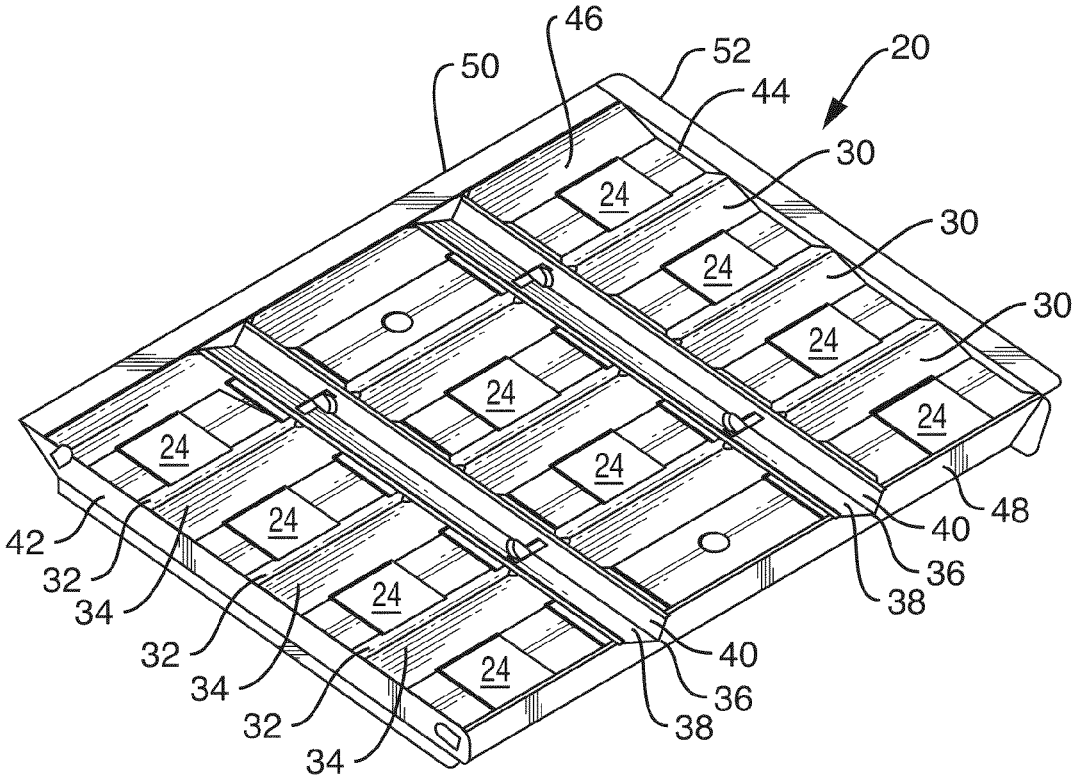
FIG. 5A is a perspective view of a reflector module of the reflector assembly of FIG. 2.
Figure 5B:
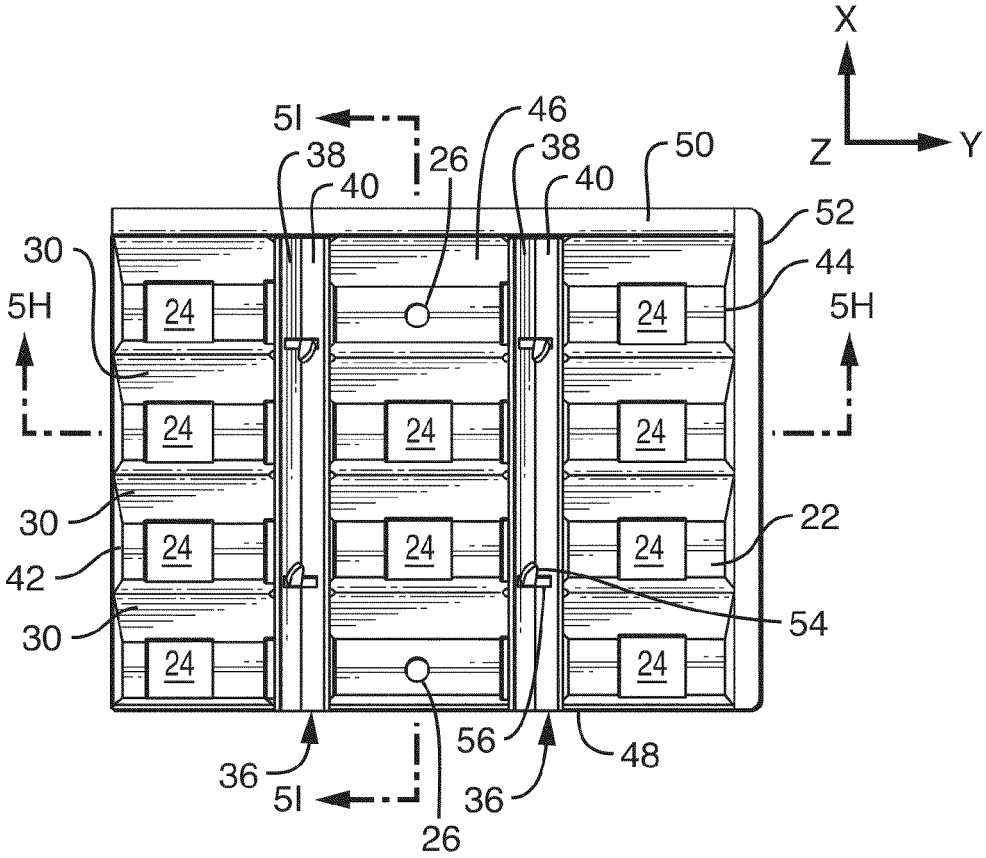
FIG. 5B is a top plan view of the reflector module of FIG. 5A.
Figure 5C:
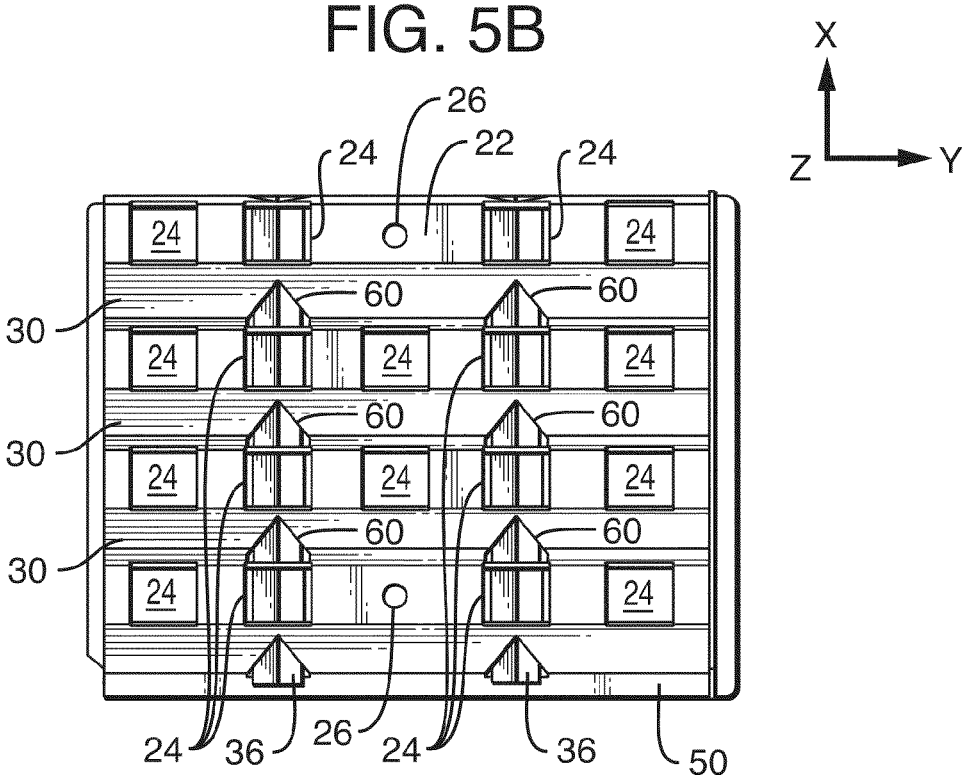
FIG. 5C is a bottom plan view of the reflector module of FIG. 5A.
Figure 5D:
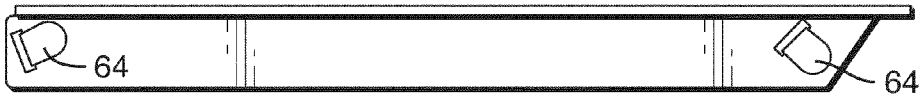
FIG. 5D is a right-side elevational view of the reflector module of FIG. 5A.
Figure 5E:
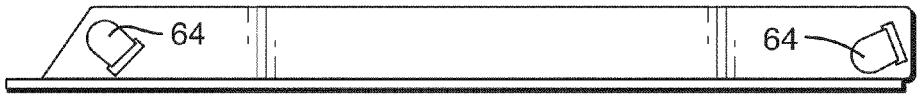
FIG. 5E is a left-side elevational view of the reflector module of FIG. 5A.
Figure 5F:
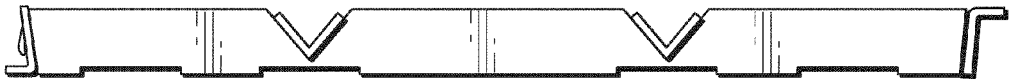
FIG. 5F is a front-side elevational view of the reflector module of FIG. 5A.
Figure 5G:
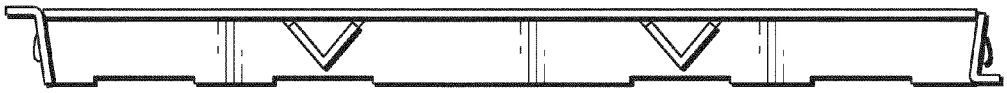
FIG. 5G is a back-side elevational view of the reflector module of FIG. 5A.
Figure 5H:
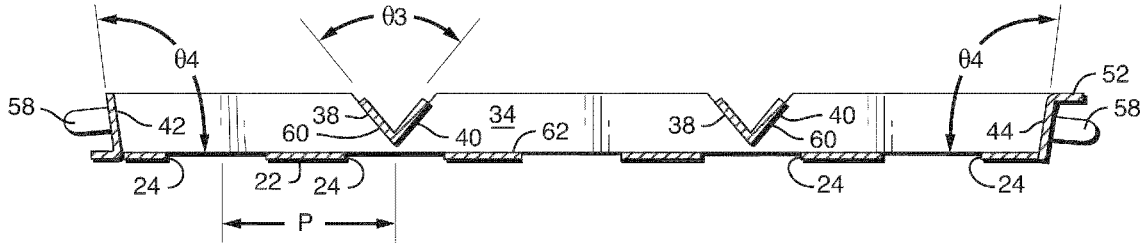
FIG. 5H is a cross-sectional view taken through 5H-5H of FIG. 5B.
Figure 5I:
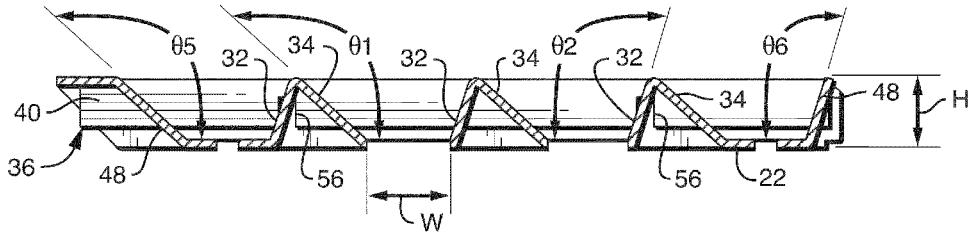
FIG. 5I is a cross-sectional view taken through 5I-5I of FIG. 5B.
Figure 6:
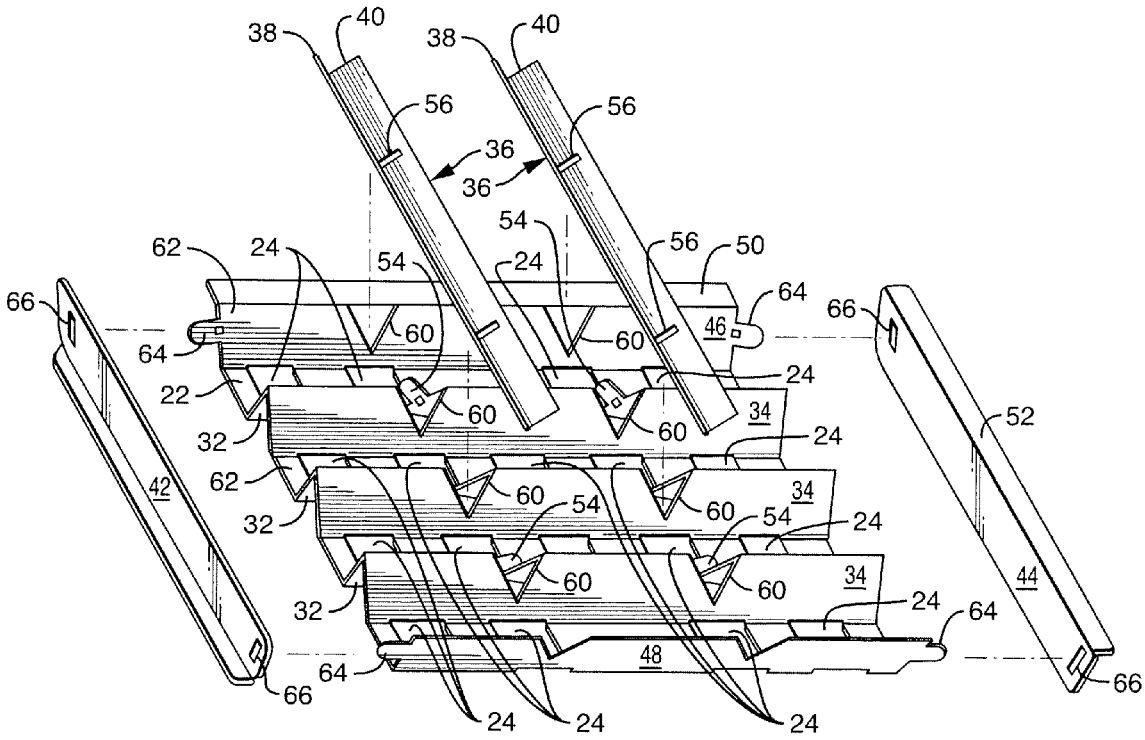
FIG. 6 is an exploded view of the reflector module of FIG. 5A.

FIG. 3 depicts a lighting apparatus 10 comprising a housing 12 of the type disclosed in copending U.S. patent application Ser. No. 12/236,243 filed Sep. 23, 2008, the entirety of which is incorporated herein by reference. Lighting apparatus 10 has a base 14 having a plurality of light sources 16. The lighting sources 16 are depicted as LEDs, but may be any other light source and the term "light source" as used herein generically refers to LEDs or any other light sources known to date or hereinafter created. The lighting apparatus 10 has a reflector assembly 18 comprised of reflector modules 20. The reflector assembly 18 of the lighting apparatus 10 is depicted as having four reflector modules 20. However, a reflector assembly could be comprised of any number of reflector modules. It is contemplated that any size reflector assembly could be created by piecing together a sufficient number and/or size of reflector modules. Similarly, despite the fact that the reflector assembly 18 is depicted as comprising reflector modules 20 that are each identically configured to the others, it is contemplated that a reflector assembly can be comprised of reflector modules of two or more different size and/or configurations in order to meet sizing requirements, light distribution requirements or other requirements.

The reflector modules 20 depicted in the figures (as best depicted in FIGS. 5A-G) have a cover plate 22 comprising a plurality of light source apertures 24 in which light sources 16 may reside when the reflector module 20 is placed on the base 14. The reflector module 20 may also comprise one or more fixing apertures 26 for allowing the reflector module 20 to be secured to the lighting assembly such as by a screw or bolt (not depicted) projecting through the fixing aperture 26 and a nut 28 being placed over the screw or bolt to hold the reflector module 20 in place. The light source apertures 24 of the depicted reflector module 20 are arranged in a matrix comprising five columns, three of which have four light source apertures 24, one of which has three light source apertures 24 and one of which has two light source apertures 24. This arrangement corresponds to a spread arrangement of LEDs of the depicted embodiment in which some LEDs removed either to leave space for fixing apertures 26 or because another LED is not needed to accomplish the desired lumen intensity or light distribution. Any arrangement and number of light source apertures is contemplated to accomplish the needs of the light assembly 10, such as the lumen intensity, light distribution or other needs.

The reflector modules 20 of the depicted embodiment comprise lateral reflectors 30 protruding out of the cover plate 22 and extending laterally along the length of the cover plate 22. In one embodiment, the reflector modules 20 are comprised of formed sheet metal and the lateral reflectors 30 are formed of the same sheet as the cover plate 22 as described in copending U.S. application Ser. No. 12/166,536, the entirety of which is incorporated herein by reference. The lateral reflectors 30 can be of any form to create the desired reflecting surfaces necessary for the light distribution sought. In the depicted reflector module 20, the lateral reflectors 30 comprise a first side 32 and a second side 34 with each side 32, 34 being substantially straight and forming an angle at their union. In the depicted embodiment, the first side 32 forms an angle $\theta_1$ with the cover plate 22 and the second side 34 forms an angle $\theta_2$ with the cover plate 22. In the depicted embodiment, $\theta_1$ is 135° and $\theta_2$ is 100°. Other angles, curved sides 32, 34 and/or additional surface characteristics are all contemplated as appropriate to create desired light distributions or otherwise.

The reflector modules 20 of the depicted embodiment also comprise overhead reflectors 36, each disposed over a column of light source apertures 24. The depicted reflector modules 20 have overhead reflectors 36 disposed over alternating columns of light source apertures 24 rather than every such column. Fewer or more overhead reflectors 36 are contemplated. For example, an overhead reflector could be located over every column of light source apertures 24, every third column, etc. or over individual light sources. As disclosed in copending U.S. application Ser. No. 12/166,536, the entirety of which is incorporated herein by reference, the overhead reflectors 36 (referenced as "directional members" and given the reference number 122 in copending U.S. application Ser. No. 12/166,536) direct a portion of the light emanating from a light source 16 immediately adjacent thereto laterally. In particular, the light emanating from a light source 16 substantially in the +Z direction is reflected laterally by the overhead reflector 36. The depicted overhead reflectors 30 are configured in substantially a V-shape having a first side 38 and a second side 40 of the V forming a vertex, the outside of which is located over the light source apertures 24, as depicted, to laterally reflect some of the light from the a light source 16 associated with the light source aperture 24. The overhead reflector first and second sides 38, 40 form an angle $\theta_3$ with each other which, in the depicted embodiment, is 84°. Other angles, curved sides 38, 40 and/or additional surface characteristics are all contemplated as appropriate to create desired light distributions or otherwise. The overhead reflectors 36 can be of any form to create the desired reflecting surfaces necessary for the light distribution sought.

In one embodiment, the reflector module 20, including all of its elements, are constructed of sheet aluminum. The reflector module 20 may be constructed from a planar sheet that is sufficiently rigid to maintain its shape. A typical planar sheet material is about 5-250 mil (about 0.1-6 mm) thick. The outer surfaces 62 of the cover plate 22 and lateral reflectors 30 are reflective surfaces, in one embodiment, with a finished surface 62 having a reflectance of at least 86%, more typically of at least 95%. In one example, the reflector module 20 is formed of a sheet of aluminum having a MIRO 4 finish, manufactured by Alanod GMBH of Ennepetal, Germany, on the outer surfaces 62. The overhead reflectors 36 may be similarly manufactured with the surfaces of the first and second sides 38, 40 opposing the light sources 16 comprising a finished surface as described above. The finished surfaces could alternatively comprise a specular finish. The surface finishes maximize reflectance and delivery of the lumens generated by the light sources 16 to the desired target area.

The instant disclosure provides the exemplary embodiment reflector module 20 having both lateral reflectors 30 and overhead reflectors 36. A reflector module is contemplated, however, having only one of these two types of reflectors and the term "reflector" when used alone (e.g. without "assembly", "lateral" or "reflector" associated therewith) shall refer generically to either a lateral reflector 30 or an overhead reflector 36 or other types of reflectors. When the term is used in the plural (i.e. "reflectors"), it may also refer to a combination of overhead or lateral reflectors or other types of reflectors.

The depicted embodiment of the reflector module 20 further comprises first and second lateral walls 42, 44 and first and second end walls 46, 48. The first and second lateral walls 42, 44 extend upward from the cover plate 22 at an angle $\theta_4$ therewith. In the depicted embodiment $\theta_4$ is 100°, but could be any desired angle to accomplish the desired light distribution and the two angles $\theta_4$ could differ. The first end wall 46 forms an angle $\theta_5$ with the cover plate 22 and can vary depending on the desire light distribution. In the depicted embodiment, $\theta_5$ is 135° to provide the same reflective angle as the second side 34 of the lateral reflectors 30. Similarly, the second end wall 48 forms an angle $\theta_6$ with the cover plate 22 that is 100° in the depicted embodiment to conform with the angle between the first side 32 of the lateral reflectors 30. Other angles $\theta_1$-$\theta_6$ may be used as necessary to accomplish the desire light distribution.

The reflector module 20 also comprises, in the depicted embodiment, an end perimeter flange 50 extending from the first end wall 46 and a lateral perimeter flange 52 extending from the second lateral wall 44. The flanges 50, 52 extend to cover the perimeter of the base 14 otherwise visible to a viewer of the lighting apparatus 10. When the reflector assembly 18 is comprises of four of the depicted reflector modules 20 arranged in the depicted pin-wheeled configuration, the end and lateral perimeter flanges 50, 52 cover the entire perimeter of the reflector assembly 18. Other flanges and flanged arrangements are contemplated to as may be desirable based on the arrangement of reflector modules 20.

The various elements of the reflector module 20 can be integrally formed together or separately. In the depicted embodiment, the cover plate 22, lateral reflectors 30, first and second end walls 46, 48 and end perimeter flange are integrally formed from a single sheet metal by operations that will be apparent to those of ordinary skill in the art. The overhead reflectors 36 are separately formed and mounted to the reflector modules 20 by resting the overhead reflectors 36 in notches 60 defined by the lateral reflectors 30 and, in the depicted embodiment, the first and second end walls 46, 48, allowing the overhead reflectors 36 to lie in each associated notch 60 approximately flush with the top of the lateral reflector 30. In the depicted embodiment, one or more of the lateral reflectors 30 have a tab 54 positioned to reside in a corresponding slot 56 defined by the overhead reflector 30 so that upon placement of the overhead reflector in the notches 60, the tab 54 will reside within the slot 56. The tab 54 is bent along one of the overhead reflector 36 first or second sides 38, 40 to secure the overhead reflector 30 to the reflector module 20. The first and second lateral walls 42, 44 are also secured to the reflector module 20 by a tab and slot system in the depicted embodiment. In particular, end tabs 64 extend from the first and second end walls 46, 48, as depicted, to reside in corresponding end slots 66 in the first and second lateral walls 42, 44 and are bent along the first and second lateral walls 42, 44 to secure them to the reflector module 20. Other manners of securing the overhead reflectors 36 and first and second lateral walls 42, 44 to the reflector module 20 are also contemplated.

Referring to FIGS. 5A-I, in the depicted embodiment, the center of the light source apertures 24 are spaced at a pitch P of 1.125 inches in both the X and the Y directions; the reflector module has a height H of 0.478 inches; a width W between the lower end of a first and second side 32, 34 of lateral reflectors 30 adjacent to a light source aperture 24 is 0.537.

The reflector modules 20 may also comprise assembly tabs 58, or other structure, extending from the perimeter for connection to an adjacent reflector module 20 or same, similar or different configuration permitting assembly of a plurality of reflector modules 20 into a reflector assembly such as reflector assembly 18 or differently configured reflector assemblies.

Figure 7:
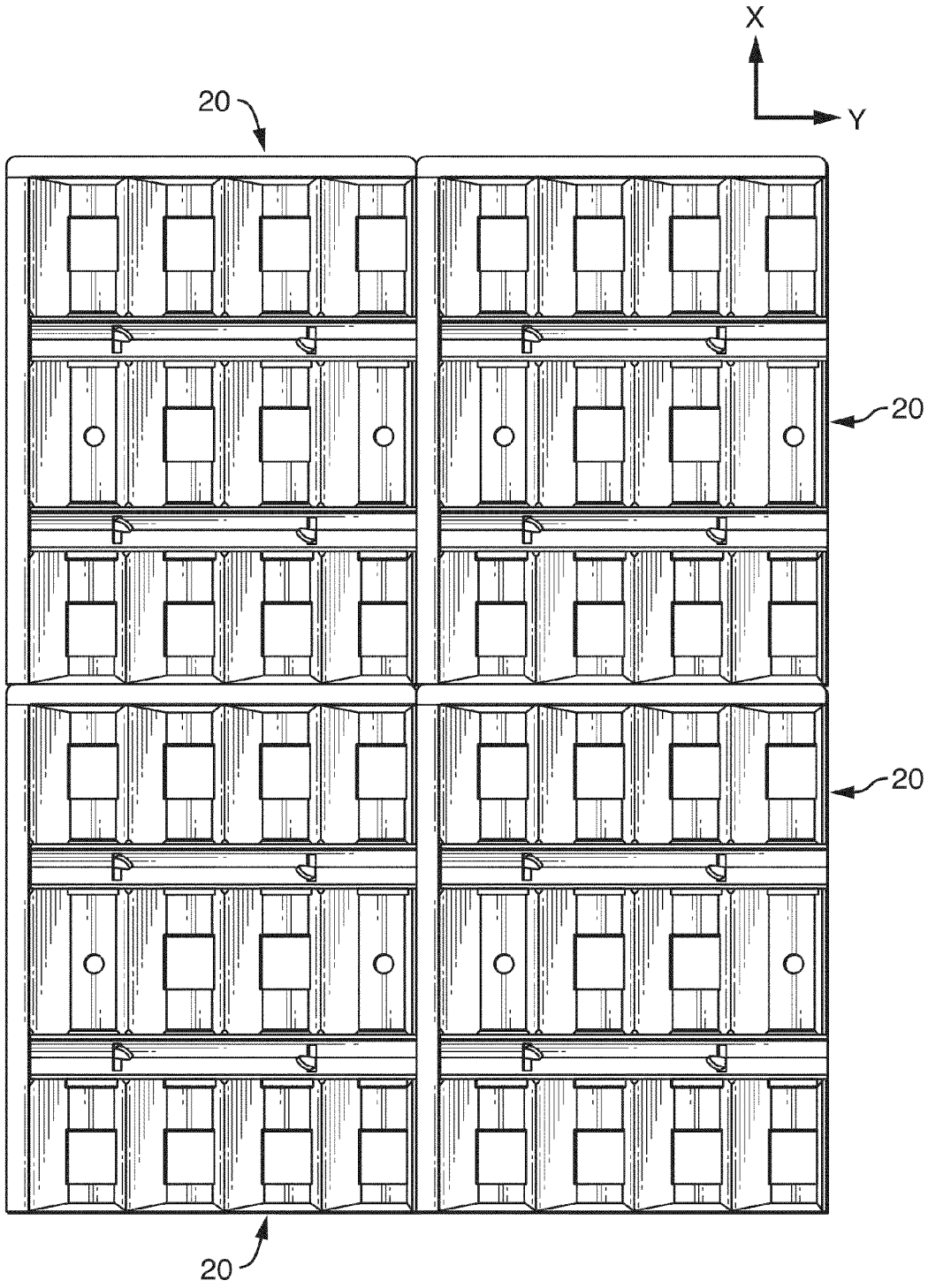
FIG. 7 is a bottom plan view of an alternative reflector assembly comprised of the four reflector modules depicted in FIGS. 5A-G, but in an alternative arrangement.

FIGS. 2, 3 and 4A-F depict one reflector assembly 18 configuration assembled from four reflector modules 20 of the configuration depicted in FIGS. 5A-I and 6. The reflector modules 20 depicted as configuring the reflector assembly 18 are each configured to direct light from the light sources 16 in the +Y, −Y and +X direction of the respective reflector modules 20. As will be understood by one of ordinary skill in the art. In doing so, each reflector module 20 provides a light distribution pattern approximating an IESNA Type II light distribution. The reflector modules 20 are depicted in the reflector assembly 18 as distributed in a pin-wheel configuration such that the +X direction of the four depicted reflector modules 20 are, one each, in the +X, +Y, −X and −Y direction of an associated lighting apparatus 10, as depicted in FIG. 3. This pin-wheeled configuration thus provides a light distribution pattern approximating an IESNA Type V light distribution. An alternative reflector assembly is depicted in FIG. 7 comprised of the same four reflector modules 20 of the reflector assembly 18 depicted in FIGS. 2, 3 and 4A-F distributed into a different configuration. More particularly, the reflector modules 20 are all oriented so that their +X direction (as defined in FIG. 5B) is pointing in the same −Y direction (as defined in FIG. 7) of the reflector assembly. Since each reflector module 20 depicted as constituting the reflector assembly in FIG. 7 provides a light distribution pattern approximating an IESNA Type II light distribution, their assembly in this manner provides a light distribution pattern approximating an IESNA Type II light distribution. This is but one example of how reflector modules 20 of one configuration may be used to approximate different light distributions. Similarly, a reflector assembly could be comprised of reflector modules having two or more different configurations to provide a desired light distribution.

The reflector assemblies described in the present disclosure provide several advantages over other devices for directing light from one or more light sources in a luminaire. One advantage is a lessening of different parts in inventory. In particular, the depicted reflector assemblies provide light patterns approximating both IESNA Type II and Type V light distributions from the same reflector modules. Only one part type need be maintained in inventory to provide IESNA Type II and Type V light distributions whereas two parts of different configurations were previously necessary. Furthermore, by lessening the number of different parts in inventory, the number of manufacturing steps, machines and processes are similarly reduced. Additionally, by comprising the reflector assemblies of two or more reflector modules, the size of each reflector module is necessarily smaller than the reflector assembly of which it ultimately becomes a part. The smaller reflector modules permit use of smaller manufacturing equipment and take less space in inventory providing commensurate reductions in costs. The reflector assemblies of the present disclosure are particularly beneficial for use with lighting apparatus having a plurality of light sources, such as the plurality of LEDs depicted in FIGS. 2 and 3, because the light emitted from different of those light sources can be directed differently depending on the selected reflector module so as to create different light distribution patters.

When employing LEDs such as the depicted light sources 16, the base 14 may be comprised of one or more light boards, and more typically a printed circuit board ("PCB"). The circuitry for controlling and powering the LEDs can also be mounted on the PCB, or remotely. In one suitable embodiment, the LEDs 16 are white LEDs each comprising a gallium nitride (GaN)-based light emitting semiconductor device coupled to a coating containing one or more phosphors. The GaN-based semiconductor device emits light in the blue and/or ultraviolet range, and excites the phosphor coating to produce longer wavelength light. The combined light output approximates a white output. For example, a GaN-based semiconductor device generating blue light can be combined with a yellow phosphor to produce white light. Alternatively, a GaN-based semiconductor device generating ultraviolet light can be combined with red, green, and blue phosphors in a ratio and arrangement that produces white light. In yet another suitable embodiment, colored LEDs are used, such are phosphide-based semiconductor devices emitting red or green light, in which case the LEDs as a group produce light of the corresponding color. In still yet another suitable embodiment, if desired, the LED light board includes red, green, and blue LEDs distributed on the PCB in a selected pattern to produce light of a selected color using a red-green-blue (RGB) color composition arrangement. In this latter exemplary embodiment, the LED light board can be configured to emit a selectable color by selective operation of the red, green, and blue LEDs at selected optical intensities.

When one or more of the light sources 16 comprise an LED, that light source may be a unit consisting of the light-generating diode and an associated optic or the light-generating diode without the optic. When present, the associated optic can be affixed directly to the diode, can be affixed to the substrate in a position next to or in contact with the diode by separate positioning and orientation means, or located or held without the assistance of the substrate or diode. The LED can be of any kind and capacity, though in a preferred embodiment, each LED provides a wide-angle light distribution pattern. A typical LED used in the present disclosure is the wide-angle LED known herein as the bilateral, high angular LED, such as Golden DRAGON® LED manufactured by Osram Sylvania or a Nichia 083B LED. Spacing between these adjacent LED lighting assemblies may be dependent upon the angle $\alpha$ of the bilateral, high angular LED.

While the disclosure makes reference to the details of preferred embodiments of the disclosure, it is to be understood that the disclosure is intended in an illustrative rather than in a limiting sense, as it is contemplated that modifications will readily occur to those skilled in the art, within the spirit of the disclosure and the scope of the appended claims.

We claim:

1. A reflector assembly for a luminaire, the reflector assembly comprising:

a first reflector module configured for associating with one or more light sources to create a first light distribution, the first reflector module comprising one or more reflectors for being located adjacent to a light source when the first reflector module is associated with the one or more light sources, the one or more reflectors configured to reflect light from the adjacent light source; and a second reflector module configured for associating with one or more light sources to create a second light distribution, the second reflector module comprising one or more reflectors for being located adjacent to a light source when the second reflector module is associated with the one or more light sources, the one or more reflectors configured to reflect light from the adjacent light source;

wherein the first light distribution and the second light distribution combine to form a third light distribution different than either the first light distribution or the second light distribution.

2. The reflector assembly of claim 1, further comprising a cover plate defining a plurality of light source apertures for allowing a light source to protrude through the cover plate.

3. The reflector assembly of claim 1, each of the reflector modules further comprising a cover plate defining a plurality of light source apertures for allowing a light source to protrude through the cover plate, at least a first of the one or more light source apertures disposed adjacent to an overhead reflector and at least a second of the one or more light source apertures disposed adjacent to a lateral reflector.

4. The reflector assembly of claim 1, each of the reflector modules further comprising a cover plate defining a plurality of light source apertures for allowing a light source to protrude through the cover plate, a plurality of the light source apertures aligned in a row and located adjacent to a lateral reflector oriented parallel to the row of light source apertures.

5. The reflector assembly of claim 1, the one or more reflectors comprising both a lateral reflector and an overhead reflector associated with one of the one or more light source apertures.

6. The reflector assembly of claim 1, the at least one reflector having a reflective surface facing the adjacent light source and each reflective surface defining a plane oriented at an angle of about 0° to about 45° from perpendicular to a plane defined by the two or more reflector modules.

7. The reflector assembly of claim 1 comprising four reflector modules pin-wheeled.

8. The reflector assembly of claim 1, each of the two or more reflector modules are oriented to direct light in the same directions from the one or more associated light sources.

9. The reflector assembly of claim 1, each of the two or more reflector modules are oriented to direct light from the one or more light sources in the +X, +Y, −Y and +Z directions of the reflector module.

10. The reflector assembly of claim 1 wherein at least two of the two or more reflector modules are substantially identical.

11. The reflector assembly of claim 1 wherein at least two of the two or more reflector modules are configured differently from each other.

12. The reflector assembly of claim 1 wherein at least one light source is an LED.

13. A luminaire comprising:

one or more light sources;

a reflector assembly comprising a first reflector module, the first reflector module associated with at least one of the one or more light sources to create a first light distribution, the first reflector module comprising one or more reflectors adjacent to the at least one of the one or more light sources, the one or more reflectors configured to reflect light from the adjacent light source; and the reflector assembly comprising a second reflector module, the second reflector module associated with at least one of the one or more light sources to create a second light distribution, the second reflector module comprising one or more reflectors adjacent to the at least one of the one or more light sources, the one or more reflectors configured to reflect light from the adjacent light source;

wherein the first light distribution and the second light distribution combine to form a third light distribution different than either the first light distribution or the second light distribution.

14. The luminaire of claim 13, at least one reflector module further comprising a cover plate defining a plurality of light source apertures and an associated light source protruding there through.

15. The luminaire of claim 13, each of the reflector modules further comprising a cover plate defining a plurality of light source apertures, at least a first of the one or more light source apertures disposed adjacent to an overhead reflector and at least a second of the one or more light source apertures disposed adjacent to a lateral reflector.

16. The luminaire of claim 13, each of the reflector modules further comprising a cover plate defining a plurality of light source apertures through which associated light sources protrude, a plurality of the light sources aligned in a row oriented parallel to an adjacent lateral reflector.

17. The luminaire of claim 13, the one or more reflectors comprising both a lateral reflector and an overhead reflector associated with one of the one or more light sources.

18. The luminaire of claim 13, the at least one reflector having a reflective surface facing the adjacent light source and each reflective surface defining a plane oriented at an angle of about 0° to about 45° from perpendicular to a plane defined by the two or more reflector modules.

19. The luminaire of claim 13, wherein the reflector assembly comprises four reflector modules pin-wheeled.

20. The luminaire of claim 13, each of the two or more reflector modules are oriented to direct light in the same directions from the one or more associated light sources.

21. The luminaire of claim 13, each of the two or more reflector modules are oriented to direct light from the one or more light sources in the +X, +Y, −Y and +Z directions of the reflector module.

22. The luminaire of claim 13 wherein at least two of the two or more reflector modules are substantially identical.

23. The luminaire of claim 13 wherein at least two of the two or more reflector modules are configured differently from each other.

24. The luminaire of claim 13 wherein at least one light source is an LED.

25. The reflector assembly of claim 1 wherein the first light distribution is substantially the same as the second light distribution.

26. The reflector assembly of claim 1 wherein the first light distribution is different from the second light distribution.

27. The luminaire of claim 13 wherein the first light distribution is substantially the same as the second light distribution.

28. The luminaire of claim 13 wherein the first light distribution is different from the second light distribution.

* * * * *